United States Patent [19]

Yamaguti et al.

[11] 4,398,337

[45] Aug. 16, 1983

[54] CONTINUAL CRIMPER

[75] Inventors: Yuji Yamaguti; Hideo Miyata, both of Neyagawa, Japan

[73] Assignee: Nichifu Terminal Industries Co., Ltd., Osaka, Japan

[21] Appl. No.: 315,655

[22] Filed: Oct. 27, 1981

[30] Foreign Application Priority Data

Oct. 28, 1980 [JP] Japan ..... 55-155654
Feb. 13, 1981 [JP] Japan ..... 56-19910

[51] Int. Cl.[3] ..... H01R 43/04
[52] U.S. Cl. ..... 29/564.6; 29/744; 29/753; 29/863
[58] Field of Search ..... 29/564.6, 744, 753, 29/863

[56] References Cited

U.S. PATENT DOCUMENTS

| | | | |
|---|---|---|---|
| 3,505,720 | 4/1970 | Heimbrock | 29/564.6 |
| 4,001,931 | 1/1977 | McKee | 29/564.6 X |
| 4,040,180 | 8/1977 | Brown | 29/753 |
| 4,175,316 | 11/1979 | Gudmestad | 29/564.4 |
| 4,179,785 | 12/1979 | Brown | 29/564.6 |
| 4,214,361 | 7/1980 | Coldren | 29/564.6 |
| 4,216,668 | 8/1980 | Walton | 29/753 X |

*Primary Examiner*—Leon Gilden
*Attorney, Agent, or Firm*—Cushman, Darby & Cushman

[57] ABSTRACT

A continual crimper for pressing an electric wire to an electric terminal, which is belted intermittently one by one, to make the wire fixed to the terminal respectively. The crimper is so constructed that the intermittently belted terminals may be transferred to its position of the next pressing step at a predetermined distance in relation with the returning action of a movable die which presses the terminal.

7 Claims, 14 Drawing Figures

CONTINUAL CRIMPER

BACKGROUND OF THE INVENTION

1. Field of the Invention

This invention relates to an apparatus for attaching an electrical connection terminal piece to an electric wire tip end, by crimping thereon, and more particularly to a continual crimper comprising: an apparatus for transferring a belting assembly of the connection terminal pieces, made of a plurality of the connection terminal pieces juxtaposedly disposed at regular spacing intervals in parallel posture with the wire-end-insertion opening uniformly facing to one side, integrally united together with interconnecting flexible planar members thus to make up such a belting assembly, the transferring being intermittent inching at a constant pitch corresponding to the said regular spacing interval so as to consecutively advance the connection terminal pieces along the direction of the said juxtaposition; and a die for crimping—by reciprocating movement thereof during the halting period of the said intermittent transferring apparatus, in cooperation with a mating stationary die—each of the connection terminal pieces as transferred by the said apparatus, thus as supplied to the forward end one after another.

2. Description of the Prior Art

In such a continual crimper, it has conventionally been the normal practice to provide, between a driving element and the transferring apparatus and between the driving element and the movable die, the respective interconnecting mechanisms so as to drive the transferring apparatus and the movable die, in proper timing therebetween, by means of the said single driving element, or else to provide separate driving elements, thus a separate second driving element particularly of the transferring apparatus, but in either case very precise mounting is required in order to actually drive the die and the transferring apparatus in the desired proper timing, as is practically quite difficult, thus to not rarely incur troubles such as poor or improper crimping and the like, on account of failure of realizing the said proper timing therebetween. As for the driving element or elements, either the hydraulic cylinder(s) or electric motor(s) may satisfactorily be used, as has conventionally been the case, but as for the interconnecting mechanism for driving the movable die, same must be constructed not only for simply reciprocatingly moving the movable die between its first position as to permit fresh supply of a new connection terminal piece to the crimping operation portion by means of the transferring apparatus and its second position where the crimping operation has been completed, but also for causing the movable die to halt at its proper position as to clampingly hold there the supplied new connection terminal piece, in cooperation with the stationary die, thus to guarantee to perform easily, securely and excellently the operation of inserting an electric wire tip end into the connection terminal piece, without suffering from inadvertent displacement or irregular posture of the terminal piece, and not to hinder the transferring movement on account of coming in the way thereof; and therefore the entire apparatus has inevitably been very complicated. Furthermore, since the connection terminal pieces to be crimped are not always of one and the same model but may in fact be of any one as may arbitrarily be selected out from variety of models, it is normal with such a continual crimper to adapt itself versatilely to such arbitrarily selected model of the electrical connection terminal pieces to be crimped, namely in due accordance with the selected size, juxtaposition-pitch and so forth of the terminal pieces, by accordingly selectively exchanging the transferring apparatus and both of the said dies, and it has thus been conventional to construct these three as are attachable to and detachable from the machine body proper independently of requiring quite troublesome labor for such work-model alteration and also of storing in good care all the parts presently not in use.

SUMMARY OF THE INVENTION

In view of the disadvantages of the conventional apparatuses as mentioned hereinabove, this invention has as its object to realize at low cost a continual crimper of the type, as is compact in size, excellent in durability and convenient in practical use, by providing an apparatus to function quite securely in comparatively simple structure.

In order to realize such a continual crimper, it is first of all needed to develop a simple mechanism for securely and smoothly operating the movable die and the transferring apparatus, keeping in good timing relationship, without incurring any trouble in performing the continual crimping operations as desired, and the primary object of this invention is thus to provide such a mechanism.

It is further preferred, in order to practically be convenient, to enable easy adaption of the crimper to work-model alteration by means of exchanging the dies and the transferring apparatus in accordance with the various models of the connection terminal pieces, and it is thus the secondary object of this invention to provide the apparatus as can quite easily be shifted over in accordance with the work-model alteration.

In order to attain the said primary object, the mechanism of the continual crimper of this invention is characterized by provision of: a driving mechanism for forcibly reciprocatingly moving the movable die in accordance with movement of the driving member; and an interconnecting mechanism, between a support member for the said movable die and the said transferring apparatus, adapted to cause the transferring apparatus to move stepwise by a constant amount every time in accordance with forced restoring movement of the said movable die; so that the movement is linearly transmitted from the driving member to the support member supporting the movable die and then from the support member to the transferring apparatus, departing from the mode with the conventional apparatus wherein there are constructed, for interconnectingly driving both the said die and the transferring apparatus, between each of them and the driving element, the respective interconnecting mechanisms; thus providing the construction for driving the transferring apparatus in interlocking with the forced restoring movement of the movable die, and thereby making it possible to effectively suppress the timing failure between the movement of the movable die and the movement of the transferring apparatus, with such simple mechanism.

To note here is that the driving element of the drivng mechanism may either be an electric motor or a hydraulic cylinder, while the driving mechanism transmits the movement of such driving element to the movable die, transforming same in the movement mode adapted to that of the movable die. Describing the mode in more detail, the movement starts when in the state of clampingly holding the connection terminal piece, when the operator inserts an electric wire tip end portion into the wire-insertion opening of the connection terminal piece and then turns on the power switch causing thereby the driving element to move, then the movable die is in consequence caused to move towards the stationary die to therealong crash and crimp the said insertion opening and also cut off the supplied connection terminal to free separate individual piece, and upon completion of the crimping then to start to move backward, so as to allow the next connection terminal piece to freely be forwarded on to the stationary die without encountering obstacle in the way, but again to move towards the stationary die, after ending the forwarding, to at last halt, as actuated by a limit switch or the like, in the fresh state of clampingly holding the said new connection terminal piece.

Now, in order to attain the secondary object, namely to provide the possibility of easily exchanging the dies and so forth, three members of: a transferring rotary body of the transferring apparatus, the movable and the stationary die serving for making up a mating pair with the movable die, are incorporated in a unit or a module, including all of the three, by means of a frame therefor, so that such a modular unit as an entirety of the handling structure may be attached to and detached from the machine body proper equipped with the driving element and the driving mechanism. Since the said three members may thusly at a stroke or in a single operation be exchanged, namely detached from and attached to the machine body proper, it has now been made possible—when proper kinds of such units each incorporating the said three members on to the frame for the attaching and detaching, corresponding to the intended models of the connection terminal pieces to be used, have duly been prepared and stocked—to then very easily and rapidly cope with the work-model alteration in accordance with the model of the connection terminal piece as desired, and also to conveniently administer the storing of the parts presently not in use.

In order that such units may conveniently be constructed, both the said dies and the transferring rotary body of the transferring apparatus are preferably incorporated in a freely exchangeable manner on to the said frame for the attaching and detaching.

DESCRIPTION OF THE PREFERRED EMBODIMENTS

Some embodiments of this invention are described hereunder with reference to the drawings.

Figure 1:
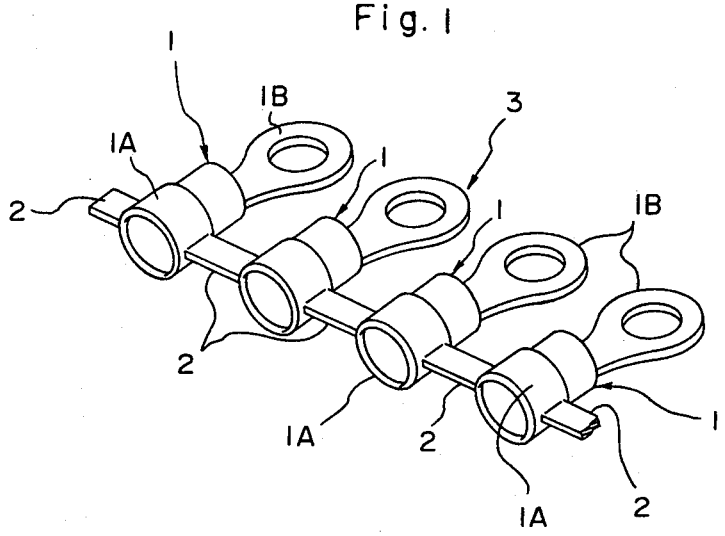
FIG. 1 shows a connection-terminal belting assembly with a plurality of interconnected connection terminals.

A connection-terminal-piece belting assembly (3) as shown in FIG. 1 is made of the connection terminal pieces (1) juxtaposedly disposed at regular spacing intervals in parallel posture with their wire-end-insertion opening uniformly facing to one side, on a series of flexible planar members (2).

Figure 2:
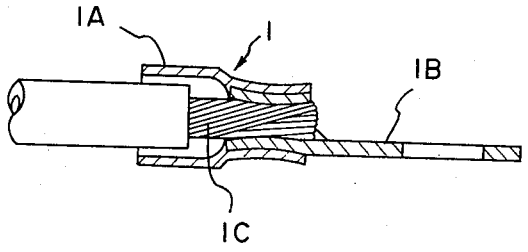
FIG. 2 is a sectional view of a connection terminal piece with an electric-wire tip end connected thereto.

Each said terminal piece (1) has such structure that an electric conductor connection terminal member (1B) made of a metal is inserted into and held by an opening mouth portion on one end of an insulator sleeve (1A) made of a plastic material; and it is subjected, as shown in FIG. 2, to the fitting operations of inserting an electric-wire tip end (1C) into the said sleeve (1A) from its opening mouth portion on the other side, namely opposite to the said one side, and of then radially plastically crashing and crimping up the whole entirety of the inserted portion, to thereby electrically as well as mechanically connect the said terminal member (1B) to the wire tip end (1C) and also mechanically connect the sleeve (1A) to the wire tipe end (1C); while the said planar members (2) are formed up integrally with the said sleeves (1A).

Figure 3:
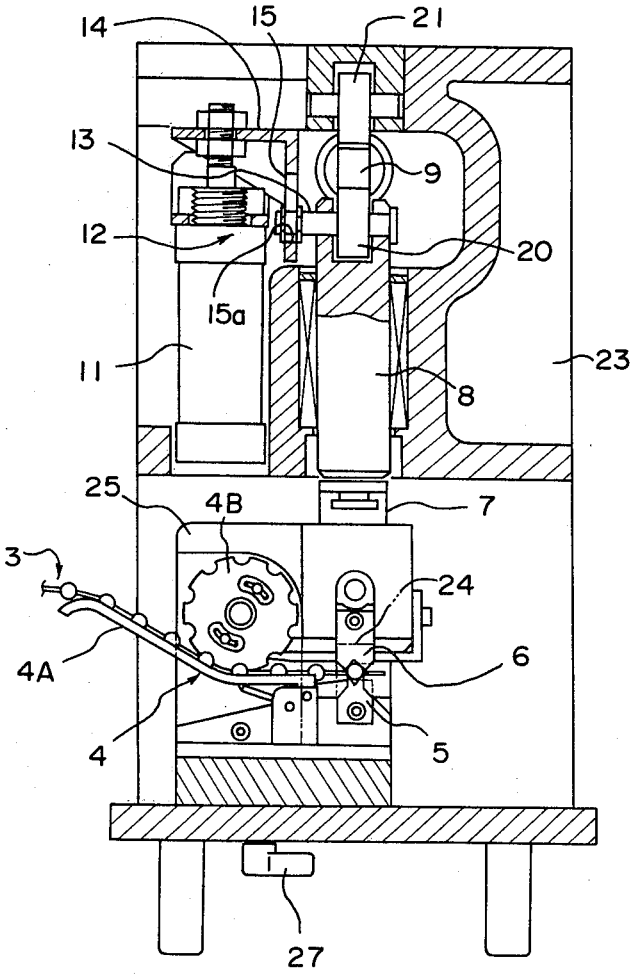
FIG. 3 is a front view of a continual crimper according to this invention, of air-cylinder type.
Figure 4:
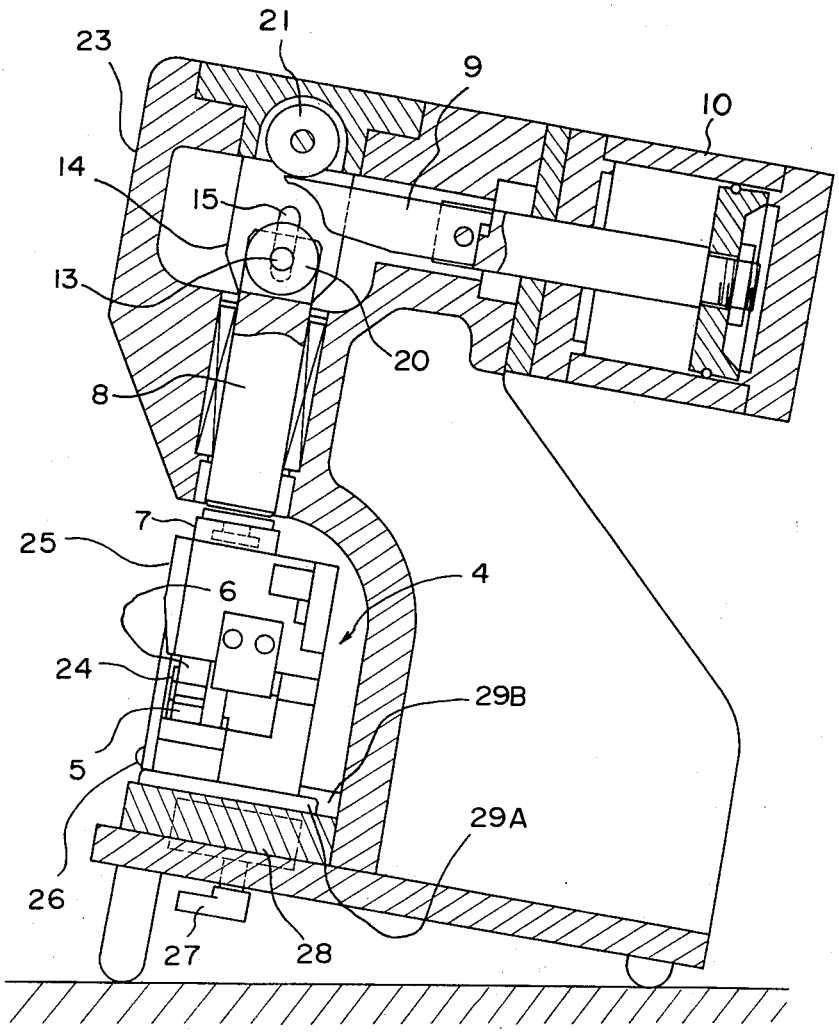
FIG. 4 is a side elevation, in section, of the said crimper.

Shown in FIG. 3 and FIG. 4 is a continual crimper having a fluid-working cylinder as its driving element; and it is constructed with: an apparatus (4) for transferring the terminal-piece belting assembly (3) as already mentioned hereinbefore; a movable die (6) adapted to function, in cooperation with a stationary die (5), to cut away, in the course of downward movement thereof while in a halting period of the said transferring apparatus (4), the transferred and supplied terminal piece (1) off the planar member (2) as well as to crimp up the piece; and driving mechanism for both the movable die (6) and the transferring apparatus (4); all being mounted on to the machine body proper (23).

The stationary die (5), the movable die (6), the transferring apparatus (4) and a support member (7) for the movable die (6), are all incorporated on to a frame (25) freely attachable to and detachable from the machine body proper (23), and an interconnecting mechanism (10) is provided on the frame (25) so as to drive the transferring apparatus (4) by movement of the support member (7).

The said support member (7) is made to be connectable with an uprightly postured member (8) as is provided at the machine body side, while all of the said dies, the transferring apparatus and the frame (25) are made to construct a unit or module, so that they may in a stroke be exchanged as a whole entirety of such modular unit. However, both the said dies and a rotary body (4B) for the transferring are fixed on to the frame in an exchangeable manner, for instance by means of screw-bolts or the like.

Figure 6:
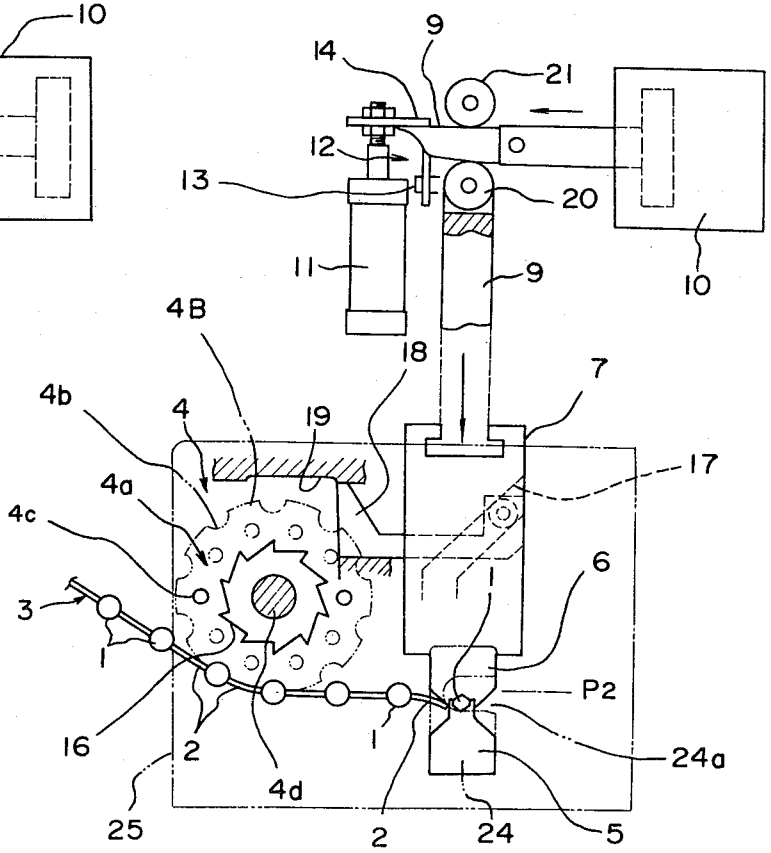
FIG. 5–FIG. 7 show, in the respective states, a driving mechanism and a transferring apparatus as well as a mating pair of dies, of the said crimper.
Figure 5:
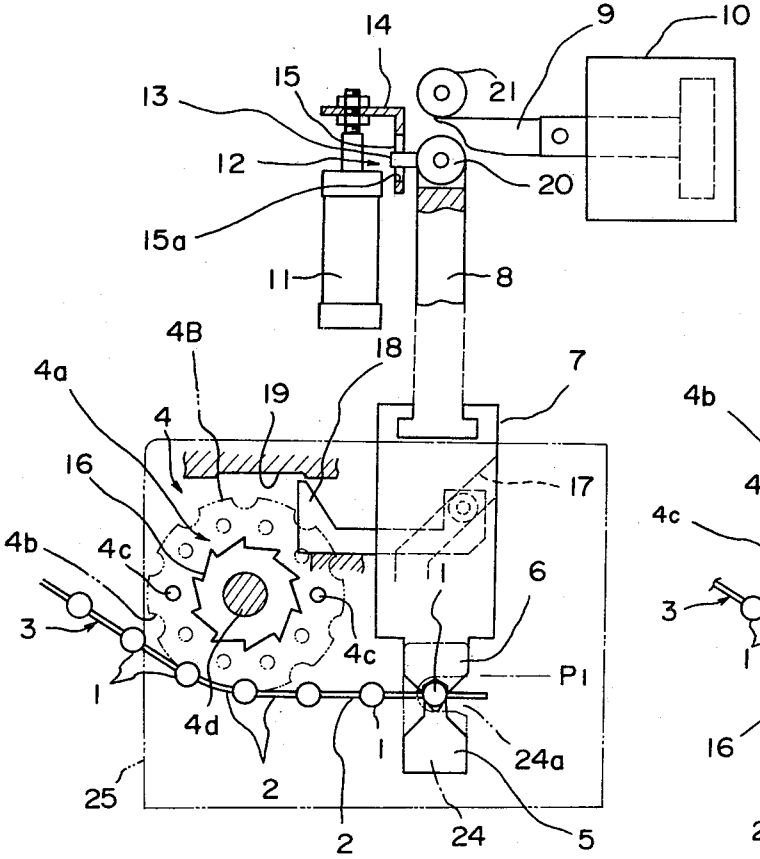
Figure 7:
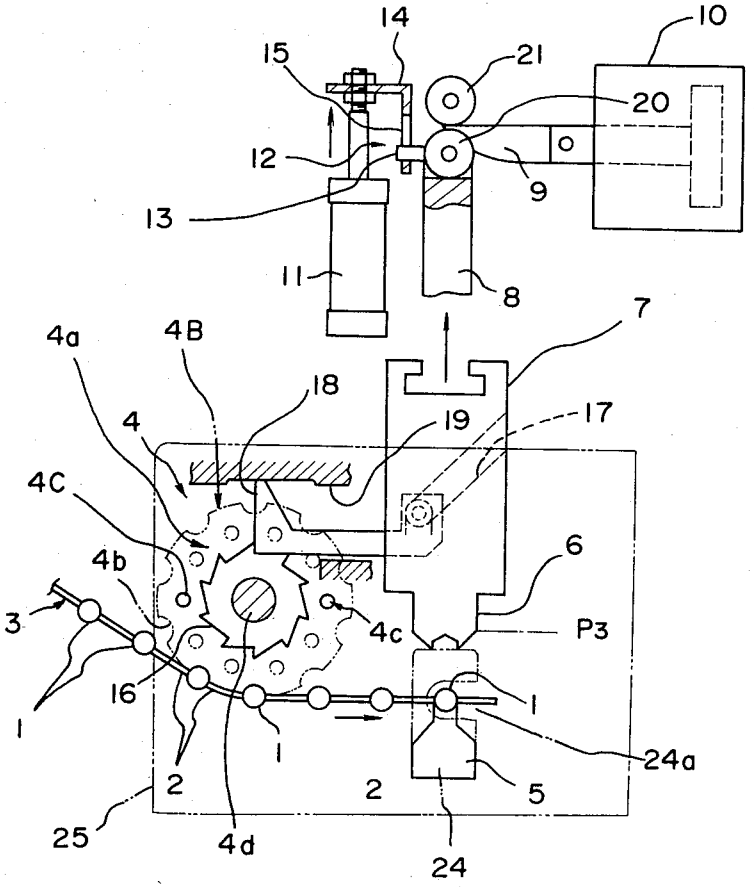

The said transferring apparatus (4) is constructed, as shown also in FIG. 5–FIG. 7; with: a guide rail (4A) (shown in FIG. 3) provided for holding thereon the terminal-piece belting assembly (3) and for guiding them as sliding thereon to the crimping section; the already-mentioned rotary body (4B) to function for transferring—by intermittent inching rotation thereof at a regular pitch via a ratchet-type transfer mechanism (4*a*) and by engaging depressions (4*b*) formed on peripheral portion thereof with the terminal pieces (1) on the guide rail (4A)—the terminal-piece belting assembly (3); and spring-balls (4*c*) provided for registeringly defining the inching rotational position of the rotary body (4B).

Transferring mechanism for the said movable die (6) is constructed with: a cam (9) provided for free horizontally reciprocating movement, thus in one and the other directions, and which is adapted to function, by the movement in the said one direction to press down an upper end portion of the uprightly postured member (8) connected to the support member (7) for the movable die (6), to thereby cause the movable die (6) to be moved from its first position ($P_1$) (shown in FIG. 5), namely the state of clamping the terminal piece, into its second position ($P_2$) (shown in FIG. 6), thus to perform the crimping operation in such course, and by the next movement in said the other direction to release the said pressing down, to thereby allow the movable die (6) to move to its first position ($P_1$); a first air-cylinder (10) provided for reciprocatingly moving the cam (9); and a second air-cylinder (11) provided laterally of the said uprightly postured member (8), as is adapted to perform one reciprocating cycle in vertical direction in interlocking with the restoring movement of the said first air-cylinder (10); wherein the said uprightly postured member (8) is so interposed in such a manner that there is provided a free play idling part in a connecting section (12) between the second cylinder (11) and the uprightly postured member (8), so as to make it possible that the movable die (6) is forcibly moved, by the outgoing actuation of the said second air-cylinder (11), from the crimping-function second position ($P_2$) to the third position ($P_3$) (shown in FIG. 7) and by the restoring movement of the second air-cylinder (11) or more particularly in consequence thereof by the weight of the movable die (6) itself (including also the weights of the uprightly postured member (8) and the support member (7)), from the third position ($P_3$) to the first position ($P_1$), and is then moved by the cam (9) connected with the said first air-cylinder (10), in abutting interlocking therewith from the first position ($P_1$) to the crimping-functioning second position ($P_2$).

The said free play idling part is so constructed that a lug (13) is provided integrally with the said uprightly postured member (8); that a member (14) is provided integrally with the second air-cylinder (11), thus to reciprocatingly move in accordance with the reciprocating movement thereof; and that in this member (14) now mentioned there is formed an oblong slit (15) in the vertical direction for fitting therein the said lug (13), as is adapted to thereby allow, when the member is positioned at the lower end of its vertical movement stroke, the said lug (13) to freely move vertically between its position corresponding to said crimping-functioning second position ($P_2$) and its position corresponding to said first position ($P_1$), yet to take the state, as the said member (14) moves to the upper end of its vertical movement stroke, to abuttingly lift, with its lower edge (15*a*), the said lug (13) up to its position corresponding to said third position ($P_3$).

The ratchet-type transfer mechanism (4*a*) of the said transferring apparatus (4) is constructed, as shown in FIG. 5, with: a ratchet gear (16) secured on a shaft (4*d*) of the rotary body (4B); a ratchet click (18) adapted to be outgoingly actuated, as the crimping die (6) moves from the second position ($P_2$) to the third position ($P_3$) via a camming groove (17) formed in the said support member (7), to thereby cause the said ratchet gear (16) to be rotated, and restoringly actuated as the crimping die (6) moves from the third position ($P_3$) to the second position ($P_2$); and a stationary guide surface (19) for slidingly guiding the reciprocating actuations of said ratchet click (18).

Designated at (20) in the drawing is a roller provided, at an upper end portion of the said uprightly postured membe (8), for the abutment thereof with the cam (9); and at (21) is a cam guide roller provided for preventing the otherwise possible upward evading flexure of the cam (9) during the outgoing movement thereof.

By the way, the said uprightly postured member (8) and the support member (7) are constructed to be disengageable; the said support member (7), the stationary die (5) and the frame (25) including the transferring apparatus (4), are constructed for free attaching and detaching with respect to the machine body proper (23) including both the said cylinders (10), (11) and the cam (9); and the guide rail (4A) in the said transferring apparatus (4) is resiliently rockably biased towards the rotary body (4B) to thus resiliently clampingly hold, in cooperation with the said rotary body (4B), the terminal-piece belting assembly (3) to be crimped.

In the construction, there is further provided in front of the said movable die (6)—as is mounted together with the said stationary die (5) on to the frame (25), in such a state as to serve also as a front cover of both the dies (5), (6)—a member (24) which functions, while allowing operation of inserting the electric-wire tip end (1C) into the supplied terminal piece (1), for abuttingly blocking the displacement of the thusly inserted wire tip end (1C) in the upward direction, (namely to the side tending to release crimping, as to the movable die (6),) with an electric-wire-tip-end-insertion opening (24*a*) of this abuttingly blocking member (24) disposed freely open toward the downstream side of said transfer so that the wire tip end (1C) thusly crimpedly connected to the crimping terminal piece (1) may be taken out toward the downstream side of the transfer off the crimping section.

Figure 9:
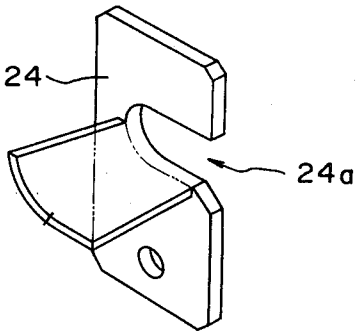
FIG. 9 is a perspective view of an abuttingly blocking member.

In more detail, the said abuttingly blocking member (24) seen in FIG. 9 is made of transparent plastic material, and this member is intended to serve, in view that when the terminal piece to be crimped is made of an electric conductor member of a metal and an insulator sleeve, to hold same as fitted therein, of a plastic material, the sleeve of the electric connector piece being crimped will strongly adhere or stick to the drivingly pressed crimping die in the course of the operation of crimpingly connecting the crimping electric connector piece and the electric wire tip end, for coping with such problem, thus for automatically and securely separate the electric connector piece sticking to the drivingly pressed crimping die upon being crimped, from such drivingly pressed crimping die.

To serve as position-setting means for the frame (25) forming up the modular unit, is a means which functions to set the position in the direction of the insertion thereof by causing the abutting engagement, in consequence of inserting the attachable and detachable frame (25) so as to connect the movable-die-support member (7) with the uprightly postured member (8), between a passive engagement lug (29A) provided as protruding on an insertion-side back surface of said attachable and detachable frame (25) and a positive engagement lug (29B) provided as protruding on the machine body proper (23), and to set the position in the direction normal to said direction of the insertion thereof by effecting said connection of the said support member (7) with the uprightly postured member (8). Additionally, to serve as means for locking the attachable and detachable frame (25) in its state as thusly positon-set with respect to the machine body proper (23), is a means wherein a magnet (28) is mounted on an attachable-and-detachable-frame-receiving platform of the machine body proper (23) and constructing a bottom portion of the attachable and detachable frame (25) as a magnetically sensitive body, thus to realize the locking by attraction therebetween.

Figure 8:
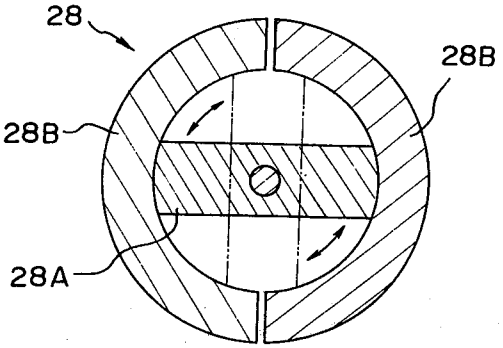
FIG. 8 is a plan view of a magnet base provided with the crimper.

The said magnet (28) has, as shown in FIG. 8, a rotationally maneuverable bar magnet (28A) and, as disposed at the rotational peripheral portion thereof, a pair of magnetically sensitive arcuate bodies (28B), (28B) with their respective end surfaces appearing in the axial direction forming the attraction surfaces for the bottom of the attachable and detachable frame (25); and therefore it is brought to the attraction-operative state, with said respective axial end surfaces of both the said magnetically sensitive bodies (28B), (28B) effectively magnetized, both of them, by rotationally positioning the bar magnet (28A) in its posture along the opposing direction of the magnetically sensitive bodies (28B), (28B), and is brought to the attraction-released states, with said respective axial end surfaces of both the said magnetically sensitive bodies (28B), (28B) demagnetized, by rotationally positioning the bar magnet (28A) in its posture normal to the first-mentioned posture (this gadjet being usually called a magnet base). Illustrated at (27) is a maneuvering lever for the said bar magnet (28A).

By the way, the said machine body (23) is constructed to be put on and secured to a working table or the like, in an inclined posture with its front face facing somewhat slantly upwardly, for providing convenience in performing the job of inserting the electric-wire tip end (1C) into the terminal piece (1) clampingly held by both the said dies (5), (6).

Figure 10:
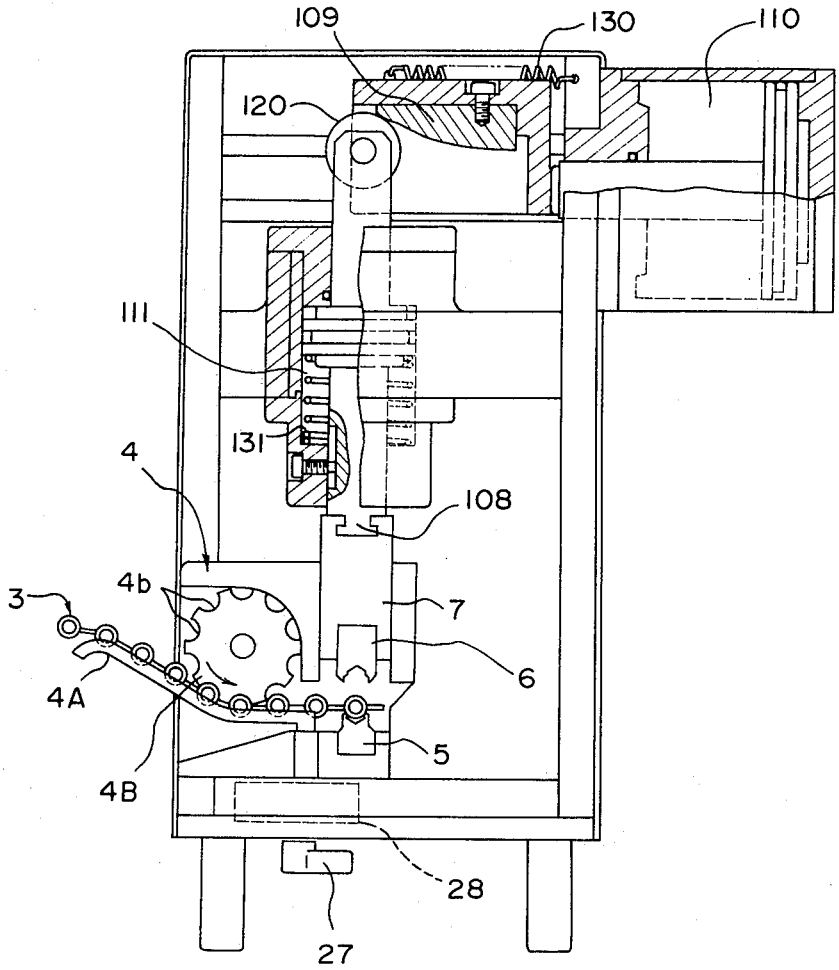
FIG. 10 is a front view of a modified embodiment of the air-cylinder type crimper.
Figure 11:
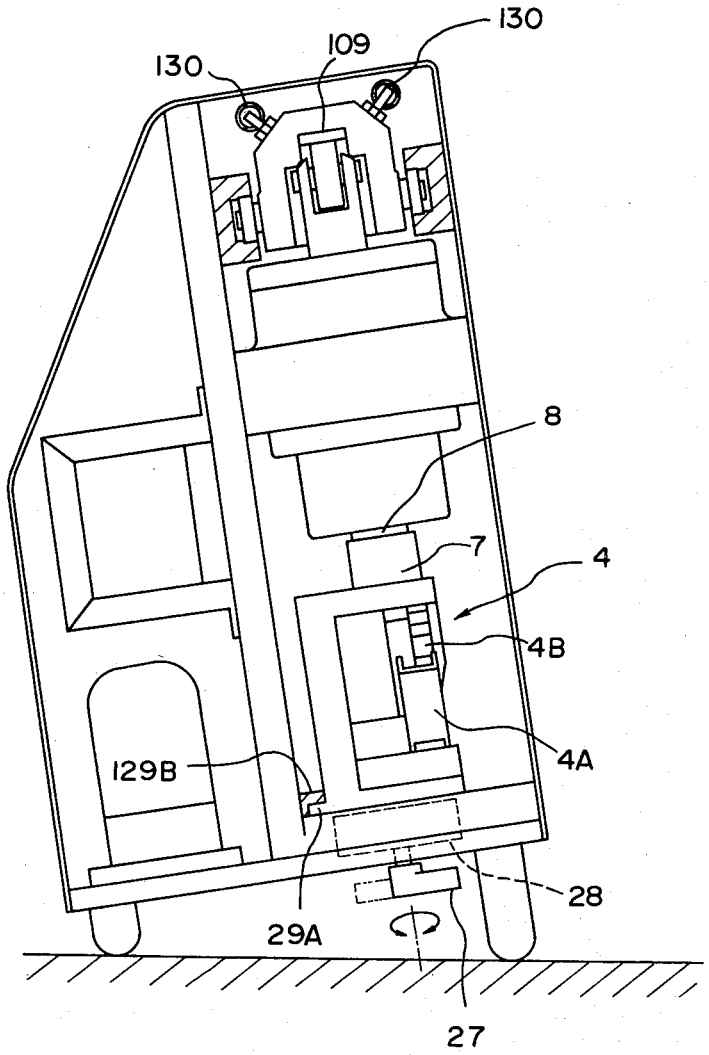
FIG. 11 is a sectional side elevation thereof.

Shown in FIG. 10–FIG. 11 is a modified embodiment which is also of the cylinder-type and which differs from the afore-mentioned one only in that springs (130) are used here for causing the restoring movement of the cylinder. Use of such springs (130) allows utilization of simple cylinder of single-working type and makes simple the valve-controling apparatus therefor. A spring (131) seen as provided on the second cylinder designated here as (111) functions as auxiliary means for lifting up the movable die. Similarly designated here at modified reference numerals, a member (109) is the cam for causing the crimping action, and at (120) provided on the uprightly postured member (108) is the roller for the cam-abutment. Still further shown here at (129B) is the lug for the position-setting of the frame (25).

Figure 12:
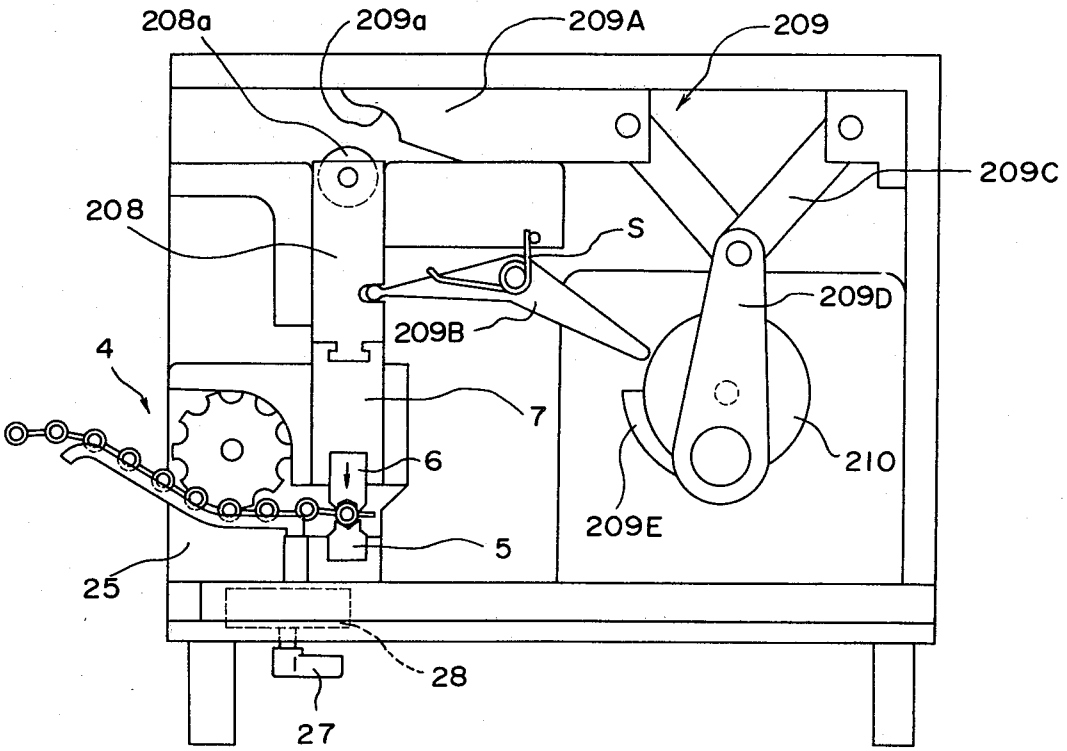
FIG. 12–FIG. 14 show, in the respective functioning states of a driving mechanism and a die-transferring apparatus, a front view of an electric type continual crimper.
Figure 13:
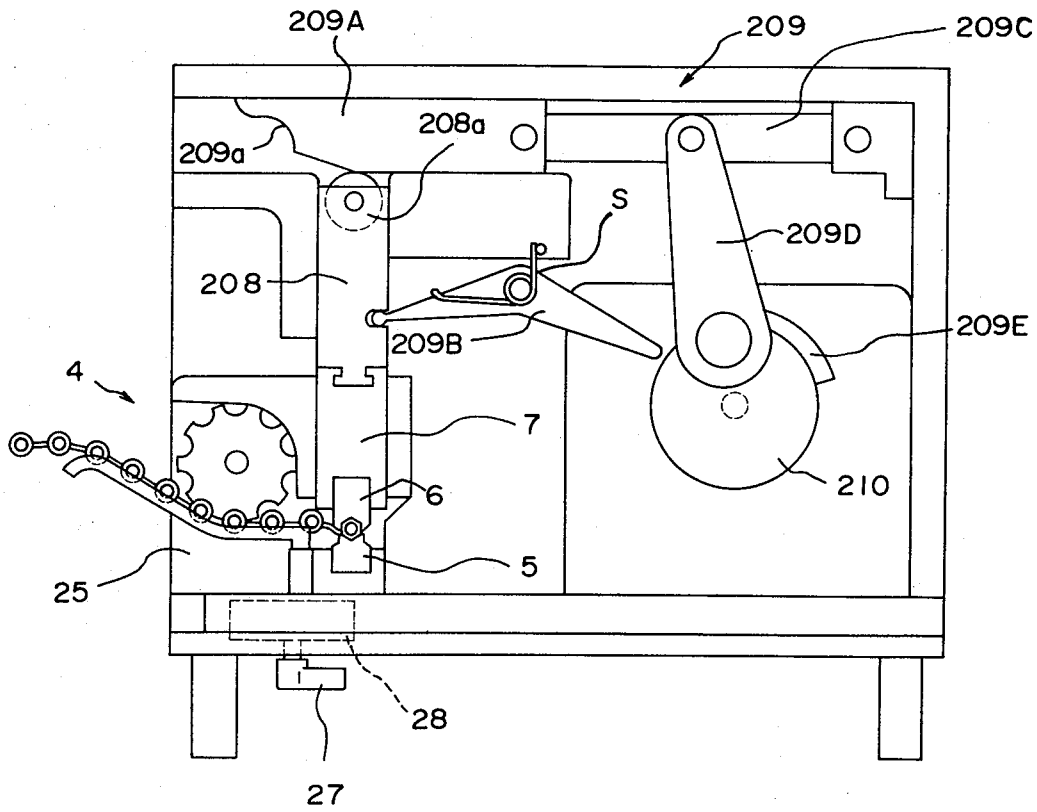
Figure 14:
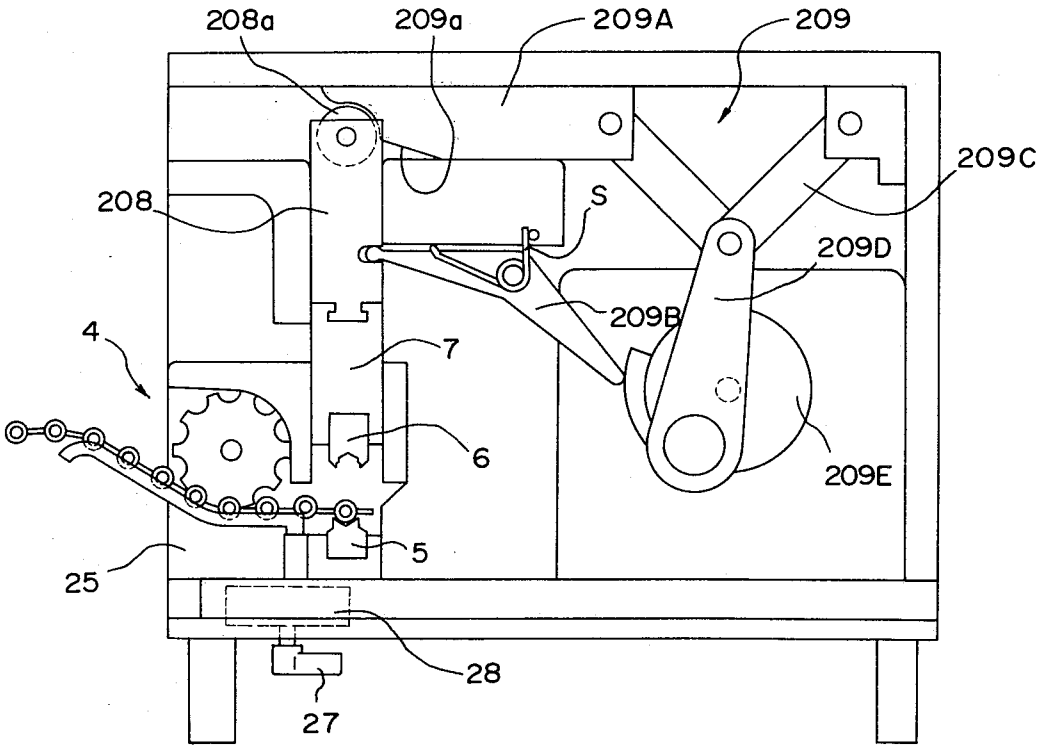

Shown in FIG. 12–FIG. 14 is an electrically powered continual crimper, with its driving mechanism in the respective different states, and there is provided, on the machine body proper, in between the said driving rotary body designated here at (210) and the said movable die, a driving mechanism (209) adapted to forcibly reciprocatingly move the movable die (6) in accordance with the intermittent rotation of the driving rotary body (210).

The said driving mechanism is constructed with: a sliding member (209A) having a camming surface (209*a*) adapted to press down a roller (208*a*) pivoted on an upper portion of the movable die (6) and thus to reciprocatingly move the movable die, with such pressing down; an articulated link (209C) adapted to reciprocatingly move the said sliding member (209A), by the articulated contraction and extension thereof, while the said driving rotary body (210) being equipped with a crank arm (209D) adapted to cause, in accordance with one complete rotation thereof, the said articulated link (209*c*) to be extended from its contracted posture and then to be brought again in its contracted posture; an arm (209B), provided for free up-and-down rocking about a horizontal axis, with one end portion thereof fittingly engaged in a support member (7) for the said movable die; and a cam (209E) provided on the said driving rotary body (210), adapted to thereby rockingly move, in accordance with the rotation thereof as to bring the articulated link (209*c*) from its extended posture to its contracted posture, the said arm (209B) in such a manner as to thereby in turn cause the movable die (6) to be restoringly moved upwards, all such function by pressing down the other end of the said arm (209B). Designated in these figures at (S) is a spring for biasing the said arm (209B) in such rocking direction as to cause said fitting engagement end thereof to move downwards.

In the state of FIG. 12, the intermittent rotary body (210) is a halt, and upon clampingly holding the terminal piece in this state, a power switch is turned on and said body is moved by rotation of a motor (not illustrated) to take the states consecutively as seen in FIG. 13 and FIG. 14, and then further again to the state of FIG. 12 where the power is cut by a limit switch thus to come there in a new halt.

We claim:

1. A continual crimper equipped with: an apparatus (4) for transferring a belting assembly (3) of crimping electric connection pieces, made of a plurality of the crimping electric connection pieces (1) in a group juxtaposedly disposed at regular spacing intervals in parallel posture with their electric-wire-tip-end-insertion opening uniformly facing to one side, integrally united together with interconnecting planar members (2) thus to make up such a belting, the transfer being intermittent inching at a constant pitch corresponding to the said regular spacing interval so as to consecutively advance the crimping electric connection pieces (1) along the direction of the juxtapostion of the group; a movable die for crimping—by reciprocating movement thereof during the halting period of said intermittent apparatus (4)—the crimping electric connection piece (1) each as supplied unitwise by the transfer by means of the apparatus (4); and a driving element adapted to move intermittently; the continual crimper being characterized in that a driving mechanism is provided, in between the said driving element and the said movable die (6) for forcibly reciprocatingly moving the movable die (6) in accordance with the intermittent movement of the said driving element; and further that an interconnecting mechanism (10) is provided as adapted to cause the transferring apparatus (4) to move stepwise by a constant amount every time in accordance with forced restoring movement of the said movable die (6) which movement is driven by the movement of the movable die (6).

2. The continual crimper of claim 1, the continual crimper being further equipped with: a frame (25) which is made freely attachable to and detachable from the machine body proper (23) and in which the said transferring apparatus (4) and movable die (6), together with a stationary die (5), are all incorporated.

3. The continual crimper of claim 2, wherein both said dies (5)(6) and said transferring apparatus (4) are constructed to be freely attachable to and detachable from the said frame (25).

4. The continual crimper of claim 2, the continual crimper being further characterized in that a positive engagement lug (29A) and a passive engagement lug (29B) are provided, respectively on the said frame and the machine body proper (23), for mutual engagement thereof to thereby set the relative position of the attachable and detachable frame (25) and the machine body proper (23); and that a magnet (28) and magnetically sensitive bodies (28B) are provided, respectively on the said attachable and detachable frame (25) and the machine body proper (23) separately, for locking, when in the position-setting state by said mating engagement lugs, such position of the attachable and detachable frame (25) and the machine body proper (23).

5. The continual crimper of any one of claims 2 to 4, the continual crimper being characterized in that the driving mechanism for the said movable die has: an uprightly postured member (108) connectable with a die-support member, and a cam (109) adapted to abuttingly press said uprightly postured member (108); and that as to constructing a driving mechanism for the said cam (109), the said cam (109) is constructed with: a fluid-pressure cylinder (11) for driving same in its outgoing direction, and a sprin (130) adapted to biasingly urge same in its restoring direction.

6. The continual crimper of any one of claims 2 to 4, the continual crimper being characterized in that as to constructing a driving mechanism for moving the said movable die (6), starting from a first position ($P_1$) for clampingly holding the supplied connection piece (1), consecutively to a crimping-functioning second position ($P_2$), then to a third position ($P_3$) for allowing a fresh supply of a new connection piece into the crimping section and then to the first position ($P_1$), the same is constructed with: a first fluid-pressure cylinder (10) adapted to move, in abutting pressing, the said movable die (6) from the first position ($P_1$) to the crimping-functioning second position ($P_2$); and a second fluid-pressure cyinder (11) for moving, in interlocking with the restoring actuation of said first fluid pressure cylinder (10), the movable die (6) from the crimping-functioning second position ($P_2$) to the third position ($P_3$) and from the third position ($P_3$) to the second position ($P_2$).

7. The continual crimper of any one of claims 2 to 4 in which the driving element of the said driving mechanism is an electric motor and which is equipped with: a cam (209A) adapted to abuttingly press an uprightly postured member from its first position to its second position; and an arm (209B) adapted to lift up same from its second position to its third position.

* * * * *